US005845548A

United States Patent [19]

Nelson

[11] Patent Number: 5,845,548

[45] Date of Patent: Dec. 8, 1998

[54] FLOORING TOOLS

[76] Inventor: Jerome S. C. Nelson, P.O. Box 855, Bozeman, Mont. 59771

[21] Appl. No.: 985,478

[22] Filed: Dec. 5, 1997

Related U.S. Application Data

[60] Provisional application No. 60/033,256 Dec. 6, 1996.

[51] Int. Cl. [6] ..... E04F 15/00

[52] U.S. Cl. ..... 81/46; 254/11; 29/254

[58] Field of Search ..... 81/46, 45, 20; 173/90, 91; 254/11; 29/254, 255

[56] References Cited

U.S. PATENT DOCUMENTS

| | | | |
|---|---|---|---|
| 847,272 | 3/1907 | Ayers | 81/46 |
| 1,159,963 | 11/1915 | Landgraf | 81/46 |
| 1,161,207 | 11/1915 | Hagel | 81/46 |
| 2,654,408 | 10/1953 | Leslie | 81/46 |
| 4,683,631 | 8/1987 | Dobbertin | 254/11 |
| 5,435,610 | 7/1995 | Roberts | 254/11 |

*Primary Examiner*—David A. Scherbel
*Assistant Examiner*—Joni B. Danganan
*Attorney, Agent, or Firm*—Richard C. Conover

[57] ABSTRACT

The flooring tool includes a slide hammer located in an elongate body. The body having a flat bottom for resting on the upper surface of the newly laid down tongue and groove flooring. The elongate body, in which the slide hammer is mounted, has at one end a depending hammer head which has an edge corresponding in shape to the edge of the tongue and groove flooring being laid. By manipulating the slide hammer, the hammer head sets the tongue and groove flooring being laid into place.

5 Claims, 3 Drawing Sheets

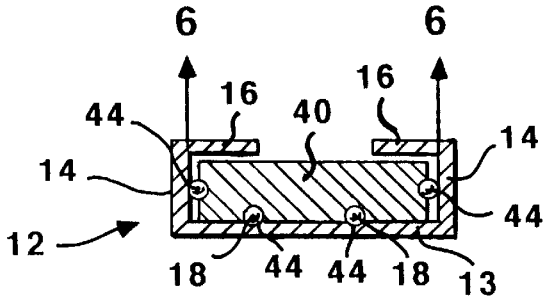
FIG.4
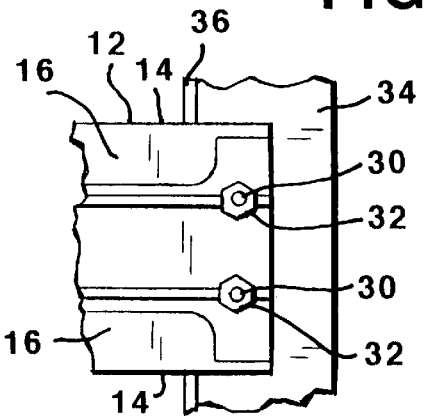
FIG.5
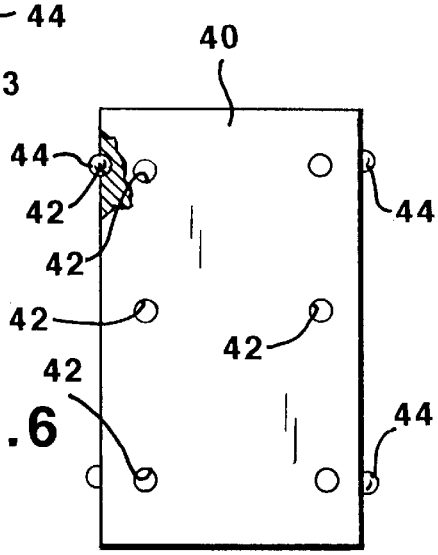
FIG.6
FIG.7
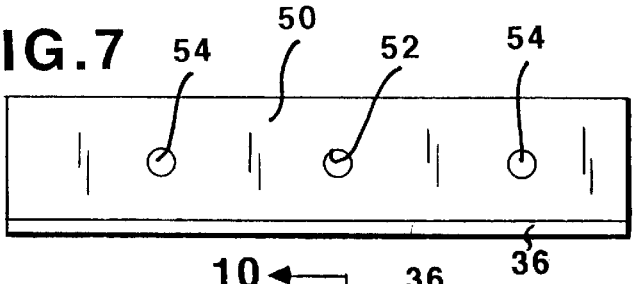
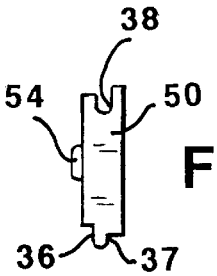
FIG.8
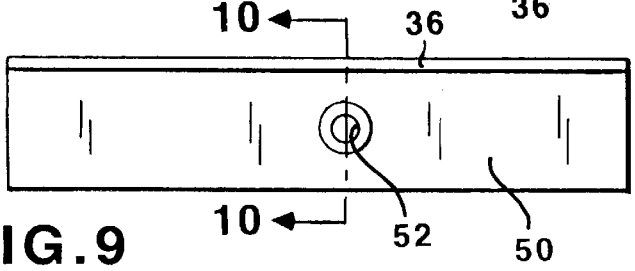
FIG.9
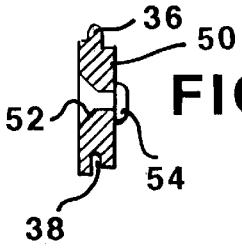
FIG.10

FLOORING TOOLS

This application claims benefit of USC Provisional application Ser. No. 60/033,256, filed Dec. 6, 1996.

BACKGROUND OF THE INVENTION

In setting tongue and groove flooring, carpenters need tools to set the tongues of one piece of flooring into the grooves of an adjacent piece of flooring without marring the upper flooring surface.

Conventionally, a tool is placed on the subflooring by the side of the flooring board to be joined with an adjacent flooring board already laid. A hammer or mallet is then used to drive the tool against the flooring board to be joined after making sure that the corresponding tongue and groove portions match.

Several patents have been issued showing tools that can also be used to force flooring pieces together. For instance, U.S. Pat. No. 665,945 to Waters, shows a floor set using a driven wedge; U.S. Pat. No. 1,577,491 to Prentice shows a floor jack using a ratchet; and U.S. Pat. No. 2,710,166 to Miller shows a floor-laying tool using a hydraulic jack. All of these conventional tools are used by positioning the tool on the subflooring adjacent the board to be joined. The tool is then manipulated to set the two pieces of flooring. In using these tools, a problem occurs when a floorer approaches a wall of the room where this flooring is being laid. In this situation, the user can no longer use the tools because the tools must be placed on the empty subfloor between the boards already laid and the wall. Under these circumstances, the floorer would have to discontinue using the tool and manually manipulate the boards into proper position in this cramped space, and set the boards together in any way available.

The present invention utilizes a tool which is placed over the flooring boards that have already been laid down, and utilizes a slide hammer to set adjacent flooring boards together.

Slide-hammers are known, but have been used for other purposes. For instance, see U.S. Pat. No. 4,454,792 to Burris which shows a slide hammer to pull stakes. This slide hammer could not be used in a manner contemplated by the present invention.

From the above, it can be seen that what is needed is a tool which is compact, easy to manipulate and, not requiring a separate mallet or hammer. The tool needs to be capable of setting flooring when the flooring being laid down approaches a wall.

SUMMARY OF INVENTION

The flooring tool of the present invention includes a slide hammer located in an elongate body. The body having a flat bottom for resting on the upper surface of the newly laid down tongue and groove flooring. The elongate body, in which the slide hammer is mounted, has at one end a depending hammer head which has an edge corresponding in shape to the edge of the tongue and groove flooring being laid. By manipulating the slide hammer, the hammer head sets the tongue and groove flooring being laid into place.

BRIEF DESCRIPTION OF THE DRAWINGS

In order that the invention may be clearly understood and readily carried into effect, preferred embodiment of the invention will now be described, by way of example only with reference to the accompanying drawings.

FIG. 4 is a cross-sectional view taken along the line 4—4 in FIG. 3 with background parts broken away;

FIG. 5 shows another alternative for attaching a hammer head to the flooring tool;

FIG. 6 is a bottom view of a complete slide as viewed from the line 6—6 in FIG. 4;

FIG. 7 is a plan view of a second embodiment of a hammer head for the flooring tool shown in FIG. 1;

FIG. 8 is a right-side view of the hammer head shown in FIG. 7;

FIG. 9 is a bottom view of the hammer head shown in FIG. 7;

FIG. 10 is a cross-sectional view of the hammer head taken along the line 10—10 in FIG. 9;

DESCRIPTION OF A PREFERRED EMBODIMENT

Figure 1:
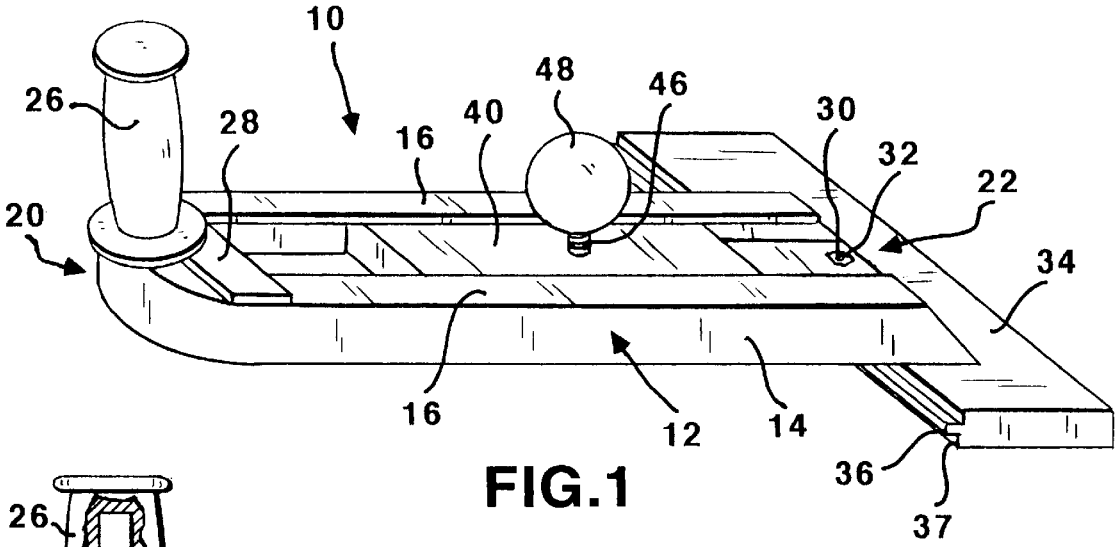
FIG. 1 is a perspective view of a flooring tool according to the present invention.

Flooring tool 10 is shown in FIG. 1. Flooring tool 10 has an elongate body 12 shown in cross-section in FIG. 4. The elongate body 12 includes a flat bottom wall 13 and a pair of spaced apart sidewalls 14. An inwardly extending rail 16 is attached to each of these sidewalls 14 as shown in FIGS. 1 and 4. The bottom wall 13 includes a pair of grooves 18 which extend along the length of the bottom wall 13 as best seen in FIGS. 3 and 4.

Figure 2:
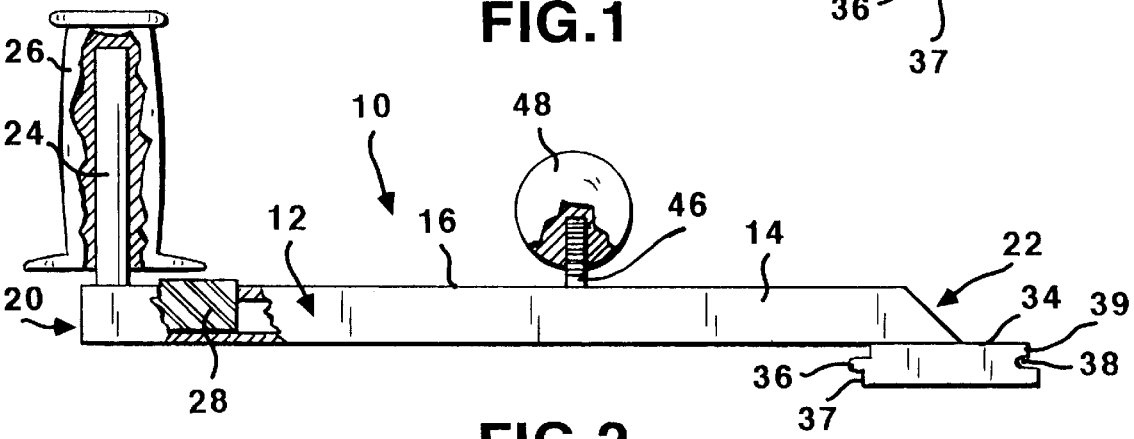
FIG. 2 is an elevational view of the flooring tool shown in FIG. 1 with parts broken away.

Elongate body 12 also has a first end 20 and a second end 22 as seen in FIGS. 1 and 2. At end 20, an upright post 24 is mounted to elongate body 12. A handle grip 26 is frictionally placed over the upright post 24 to provide a handgrip for an operator.

Figure 3:
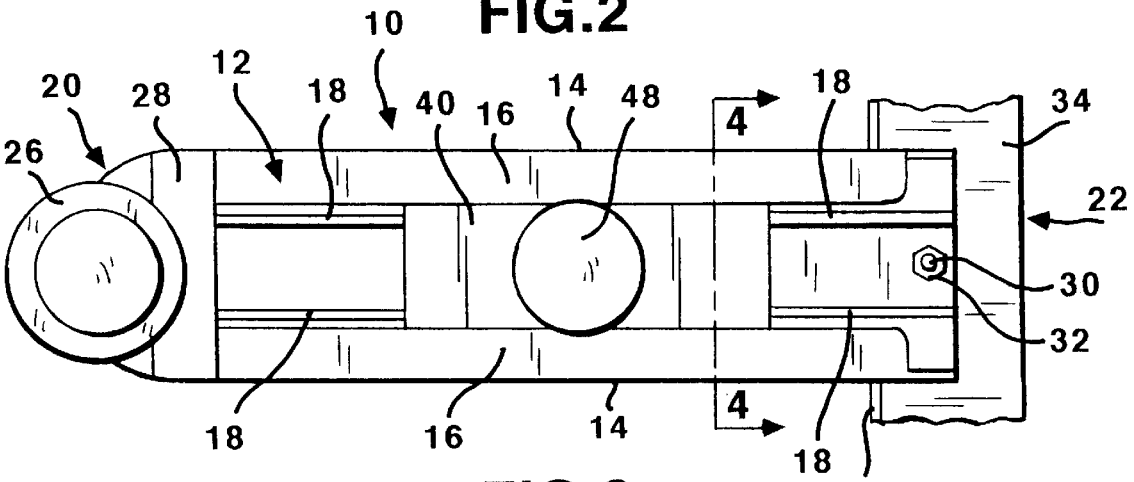
FIG. 3 is a plan view of the flooring tool shown in FIG. 1.

A backstop/impact bar 28 is attached to body 12 as by welding across sidewalls 14 as shown in FIGS. 2 and 3.

As shown in FIG. 1, a hammer head 34 is secured in depending fashion to elongate body 12 at second end 22 of body 12 with a bolt 30 countersunk in hammer head 34 which bolt threadably receives a nut 32. With this arrangement, the hammer head 34 may swivel with respect to elongate body 12. The hammer head 34 may be attached to body 12 with a pair of countersunk bolts 30 and nuts 32 as shown in FIG. 5. With this arrangement, a hammer head 34 is prevented from rotating with respect to elongate body 12.

The hammer head 34 is a narrow replica of the tongue and groove flooring being laid down. On one side of hammer head 34, a tongue 36 extends along the hammer head 34. The tongue 36 is positioned to fit into the groove of the flooring being laid when the hammer head 34 rests on the subflooring. One side of tongue 36 is dimensionally shorter than the opposite side of the tongue as shown in FIG. 2. This shorter side, which in a preferred embodiment is 0.020 inches shorter, is labeled 37 in FIG. 2.

On side of hammer head 34 opposite tongue 36, a groove 38 is provided which extends along the hammer head. Again the groove 38 is sized to match with the tongue of the flooring being laid down when the hammer head 34 rests on the subflooring. One side of groove 38 is dimensionally shorter than the opposite side of the groove as shown in FIG. 2. The shorter side, which in a preferred embodiment is 0.020 inches shorter, is labeled 39 in FIG. 2.

The shorter length 37 of tongue 36 is placed on the bottom of hammer head 34, as shown in FIG. 2. This shorter length engages the side of the groove of the flooring piece being set. The opposite longer length of the tongue 36 is spaced apart from the upper surface of the flooring by 0.020 inches to prevent marring of the flooring pieces when the tool is being used. Similarly, the shorter length 39 of hammer head 34 is positioned above the longer length of groove 38 when hammer head 34 is used. In driving a flooring piece to be laid against adjacent flooring, the longer length engages the flooring piece with the shorter length 39 being separated from the upper surface of the flooring piece being laid by 0.020 inches so that the upper face of the flooring being laid is not marred.

The flooring tool 10 includes a hammer slide 40 as shown in FIGS. 1 and 4, the hammer-slide is dimensioned to slide freely on top of bottom wall 13 of the elongate body 12 and underneath rails 16 as best seen in FIG. 4. The slide 40 is free to slide along the bottom wall 13 of elongate body 12 between the back stop 28 and nut 32.

The slide 40 is provided with hemispherical depressions 42 as shown in FIG. 6 for holding ball bearings 44 as shown in FIGS. 4 and 6. The ball bearings 44 are provided on the sides of slide 40 as well as on the bottom surface of slide 40 as seen in FIGS. 4 and 6. The ball bearings on the sides of slide 40 just roll along the interior surface of side walls 14 and the ball bearings 44 on the bottom of slide 40 roll in the grooves 18 provided in wall 13 of elongate body 12.

A threaded post 46 extends upwardly from the top of slide 40 as shown in FIG. 2 to provide support for knob 48 which is screwed on top of the threaded post. Knob 48 extends above the top of body 12 so that an operator can grip a handle 26 with one hand, and with the other hand grip knob 48 to slam slide 40 into backstop 28. When hammer slide 40 is slammed into backstop 28, the hammer head 34 drives the flooring board into the adjacent groove or tongue of the flooring board already laid.

Several alternative embodiments of hammer heads 34 that can be used with elongate body 12 will now be described. As shown in FIGS. 7–10, a swivel tongue-and-groove hammer head 50 has lumps 54 placed on the top of the hammer head as by welding. Lumps 54 are spaced apart from countersunk bore 52 and are also spaced apart from body 12 when the hammer head is bolted to the body 12 with bolt 30 and nut 32. Hammer head 50 can then swivel through a number of degrees until one of the lumps 54 contacts the side of body 12. This lump 54 prevents further rotation of hammer head 34. In this manner, lumps 54 act as stops to prevent large rotations from occurring as hammer head 50 is used to contact the tongue-and-groove flooring.

Figure 11:
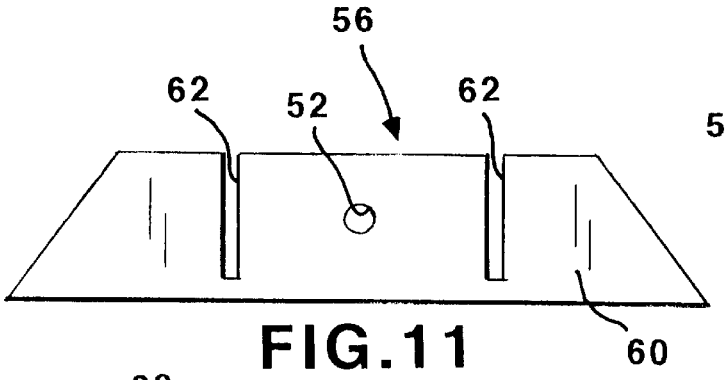
FIG. 11 is a plan view of a third embodiment of a hammer head for the flooring tool shown in FIG. 1.
Figure 13:
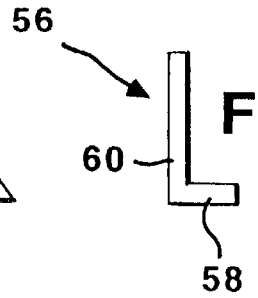
FIG. 13 is a right-side view of the hammer head shown in FIG. 11.
Figure 12:
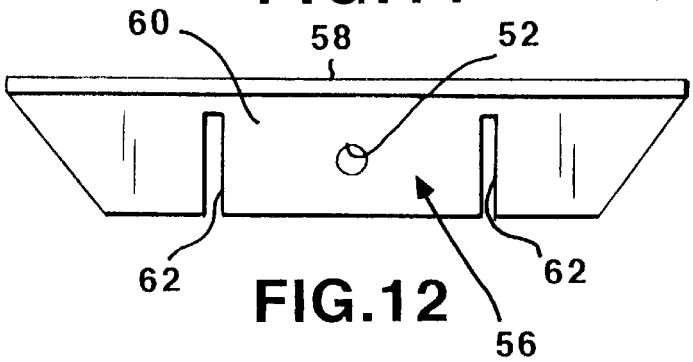
FIG. 12 is a bottom view of the hammer head shown in FIG. 11.

Another hammer head, angle-iron hammer head 56, is shown in FIGS. 11–13. Angle-iron hammer head 56 can be used when a flooring board to be laid has either a planar or grooved edge. Angle-iron hammer head 56 has a side 58 and a top 60 that extend approximately perpendicular to each other. As top 60 rests on a board, side 58 can contact the edge of the board so that pressure can be applied. In addition, notches 62 are cut into top 60. Notches 62 accommodate sides 14 of the body 12 when hammer head 56 is bolted to bottom wall 13 of body 12 to avoid interference. Again a countersunk bore 52 is provided through top 60 to provide a passageway for bolt 30 to bolt angle-iron hammer head 56 to body 12.

Figure 14:
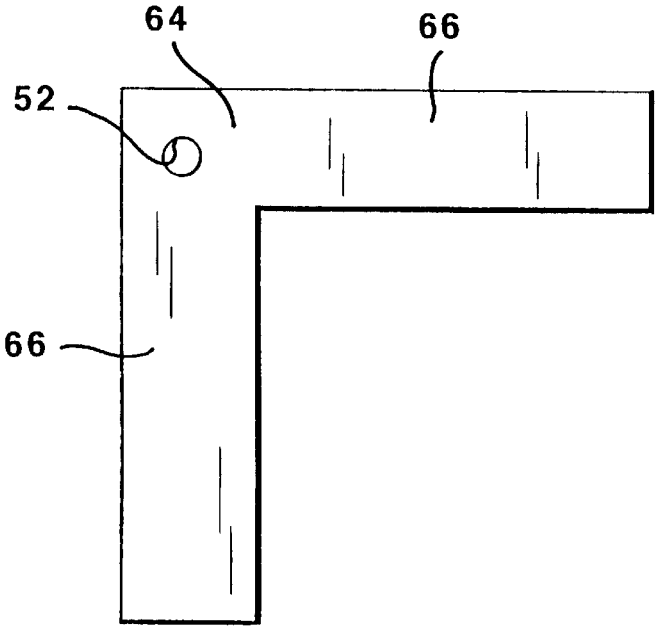
FIG. 14 is a fourth embodiment of a hammer head for the flooring tool shown in FIG. 1.
Figure 15:
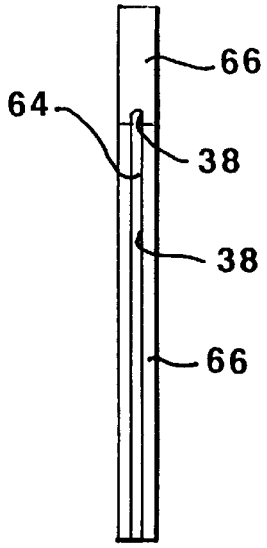
FIG. 15 is a right-side view of the hammer head shown in FIG. 14.

Another alternative, right-angle hammer head 64, is shown in FIGS. 14 and 15. Hammer head 64 has generally perpendicular arms 66 each of which have a groove 38 on the inside edge for mating with a tongue of a flooring board being laid. A countersunk bore 52 extends through hammer head 64 adjacent the corner formed by the meeting of perpendicular arms 66 to provide a passageway for bolt 30. This hammer head 64 is used to set a flooring board with a force being applied in two directions to simultaneously set an end and side joints of a flooring board being laid.

In operation, an appropriate tongue-and-groove hammer head 34 is bolted to body 12 with countersunk bolt 30 and nut 32. Nut 32 is not tightened so much that the nut prevents hammer head 34 from rotating as desirable. With the embodiment shown in FIG. 5, nuts 32 may be tightened because the hammer head 34 with this embodiment will not rotate. An appropriate side of hammer head 34 is oriented under body 12 so that it may be placed in mating contact with the flooring material to be set. The elongate body 12 is placed on top of the flooring board laid with the depending hammer head 34 hooked over the flooring to be set.

An operator then grips handle grip 26 in one hand and knob 48 in the other hand. The operator can then move slide 40 out against nut 32. By smartly bringing slide 40 toward handle grip 26, the slide will soon slam against backstop 28 with a hammer-like blow.

When slide 40 contacts backstop 28, the inertia of the slide and body 12 causes a rather large pressure to be applied to hammer head 34. Since hammer head 34 is in mating contact with the tongue-and-groove flooring material, the flooring material is moved smartly toward the flooring piece already laid. The setting operation is accomplished with this hammering action without marring the flooring surface. The shortened lengths 37 and 39 of hammer head 34 assure that the top surface of the flooring board will not be marred.

The several different hammer heads shown in FIGS. 7–15 permit variations in this sequence to be performed. If a swivel tongue-and-groove hammer head 50 is used, the hammer head can not rotate 180 degrees once nut 32 is loosely tightened down on bolt 30 because lumps 54 contact body 12 after only a partial rotation occurs. Lumps 54 keep one edge of hammer head 50 oriented toward handle grip 26 so that a succession of flooring pieces can be laid down without having to readjust the mating side of hammer head 50. This prevents delays causes by the hammer head becoming misaligned.

If angle-iron hammer head 56 is connected to body 12, this hammer head may be used with flooring boards which do not have a conventional tongue shaped edge.

If corner hammer head 64 is connected to body 12, this hammer head may be used to set a flooring board in place providing setting force to the end joint and the side joint.

The various hammer heads and alternatives have been described to illustrate different tools that can be used to lay down a tongue-and-groove floor easily without marring the flooring surface.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. A flooring tool used to set flooring material having opposite exposed edges, the tool comprising:

an elongate body having a first end and a second end;

the elongate body having a longitudinal slot extending from a position adjacent the first end to the second end;

an impact bar positioned in the slot adjacent the first end;

a slide positioned in the slot and sized for slideable movement in the slot; and a hammer head attached to the elongate body adjacent the second end in depending relation thereto;

the hammer head having an edge for mating with an exposed edge of the flooring material.

2. The flooring tool according to claim 1 wherein the slide is provided with a handle grip and the elongate body is provided with a handle grip attached at the first end of the elongate body.

3. The flooring tool according to claim 1 wherein the hammer head is fixedly attached to the elongate body.

4. The flooring tool according to claim 1 wherein the hammer head is pivotally attached to the elongate body.

5. The flooring tool according to claim 4 further including stop means provided on the hammer head to limit pivotal movement of the hammer head.

* * * * *